United States Patent [19]

Easton et al.

[11] 3,934,875

[45] Jan. 27, 1976

[54] HOCKEY STICK

[76] Inventors: James Leland Easton, 15141 Mulholland Drive, Los Angeles, Calif. 90024; Gary William Filice, 19544 Wells Drive, Tarzana, Calif. 91356

[22] Filed: Feb. 14, 1974

[21] Appl. No.: 442,640

[52] U.S. Cl. ..... 273/67 A; 273/80.2

[51] Int. Cl.[2] ..... A63B 59/12

[58] Field of Search ..... 273/67 A, 80.2–80.8, 273/82 R, 82 A, 167 R

[56] References Cited

UNITED STATES PATENTS

| | | | |
|---|---|---|---|
| 1,202,383 | 10/1916 | Hardman | 273/80.2 |
| 1,520,108 | 12/1924 | Bishop et al. | 273/82 A |
| 2,027,635 | 1/1936 | Cunningham | 273/80.2 |
| 2,463,053 | 3/1949 | Pritchard | 273/80.3 X |
| 3,025,061 | 3/1962 | Ernst et al. | 273/82 R |
| 3,176,987 | 4/1965 | Johnston | 273/80.2 X |
| 3,561,760 | 2/1971 | Klay | 273/67 A |
| 3,582,081 | 6/1971 | Caplan | 273/80.6 UX |
| 3,638,942 | 2/1972 | Bassett | 273/67 A |
| 3,720,410 | 3/1973 | Saytar | 273/67 A |
| 3,851,880 | 12/1974 | Ritch | 273/67 A X |

FOREIGN PATENTS OR APPLICATIONS

| | | | |
|---|---|---|---|
| 371,294 | 4/1932 | United Kingdom | 273/67 A |
| 489,072 | 12/1952 | Canada | 273/67 A |

OTHER PUBLICATIONS

"The Sporting Goods Dealer," Dec. 1972, pp. 49 and 146.

"Modern Plastics," Feb. 1953, p. 106.

*Primary Examiner*—Richard J. Apley

*Attorney, Agent, or Firm*—Ralph M. Braunstein

[57] ABSTRACT

A hockey stick is formed of a fiber-reinforced plastic blade integrally molded onto a tapered metal shank which mates with a rectangular tubular metal shaft or handle to form a four-plane lap joint which is bonded with a thermoplastic adhesive. The metal shank includes a longitudinally tapered recess which is filled by the molded plastic of the blade to form a virtually indestructible bond between blade and shank. The configuration provides great strength and precisely controllable flexibility with easy replaceability of the blade.

5 Claims, 4 Drawing Figures

HOCKEY STICK

BACKGROUND OF THE INVENTION

The popularity of hockey both as a spectator sport and as a participatory activity has created a substantial demand for hockey sticks which have traditionally been made of wood. As the sticks commonly receive very rough treatment in play, they are subject to a high rate of wear and breakage. It is not unusual for each player on a team to require several replacement sticks during a single game. Among professional players especially, there are strong individual preferences for hockey sticks having particular characteristics of size, weight and flexibility so that a large supply of sticks must be kept on hand to ensure that each team member will have an immediately available replacement of his preferred type whenever it becomes necessary. The cost of the sticks consumed by wear and breakage is appreciable, as is the burden of maintaining a large inventory of spares which must travel with the team.

The cost of hockey sticks is also a matter of concern to individual amateurs who must supply their own equipment and are not likely to carry spares about with them. Thus, a broken or damaged stick may terminate such a person's opportunity to participate at a particular time, as well as cause him the trouble and expense of shopping for and obtaining a new stick. Without the assistance of a professional's team staff, the individual may not readily locate a stick having his favorite weight and flexibility characteristics, and be forced to settle for one less than optimum for his playing style and ability.

Due to the severe requirements of the game, the construction of quality wooden hockey sticks has dictated the selection of high grade wood stock which is always relatively scarce and has become quite costly with increasing demand for use in the manufacture of hockey sticks and other items.

For the foregoing reasons, it is highly desirable to provide hockey sticks of materials other than wood which are resistant to wear and breakage as well as lending themselves to fabrication with consistently reproducible weight and flexibility characteristics. A further desirable feature is an easily replaceable blade, which is the portion most subject to the normal abuse of the game. By enabling such replacement, a player will be permitted to retain his favorite shaft, further reducing the cost of replacement and the size of the inventory which must be maintained to support a team with an active schedule.

SUMMARY OF THE INVENTION

A hockey stick embodying this invention has a metal handle or shaft formed of hollow rectangular tubing. The replaceable blade is preferably made of a composite material, such as fiber-reinforced plastic, which is molded about the lower portion of a tapered metal shank extending into the heel of the blade. The surface of the lower portion of the shank has at least one recess which is filled with the molded blade material so that a permanently integral structure results. The upper portion of the shank is mated with the lower end of the shaft in a four-plane lap joint which is bonded with a thermoplastic adhesive to form a union of great strength which may, nevertheless, be released by applying heat to soften the thermoplastic material.

Flexibility of the stick in the critical "throat" region is, according to the invention, controlled by adjusting the degree of position of the taper on the metal shank. In addition, the less critical playing characteristics of the shaft or handle may be controlled by selecting the thickness of the walls of the metal tube and, if desired, tapering the wall thickness on one or more sides of the rectangular cross-section in selected regions.

DETAILED DESCRIPTION OF THE DRAWINGS

Figure 1:
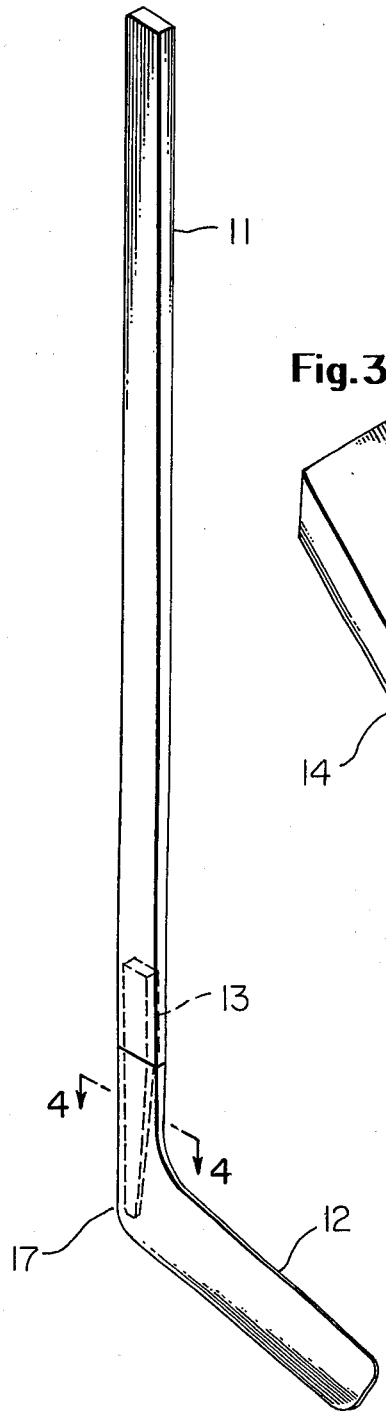
FIG. 1 is a perspective view of a hockey stick embodying the invention.
Figure 2:
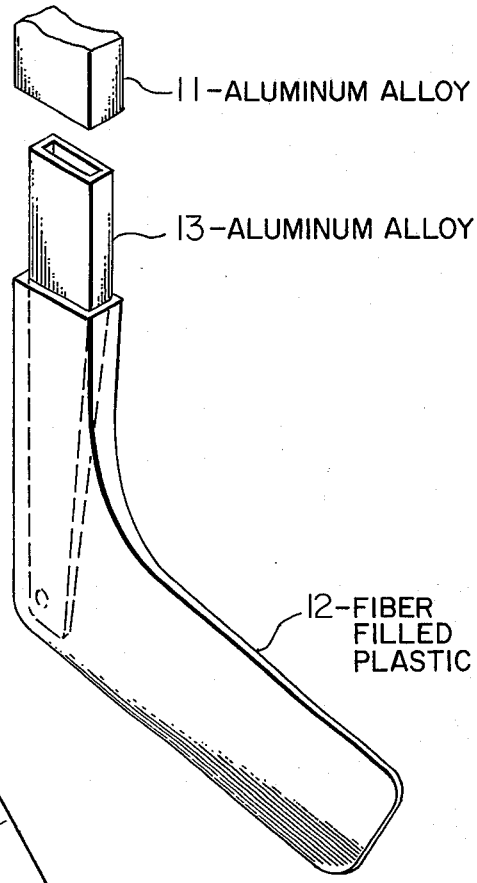
FIG. 2 is an exploded perspective view of the lap joint by which the blade shank is connected to the shaft or handle of the hockey stick shown in FIG. 1.
Figure 3:
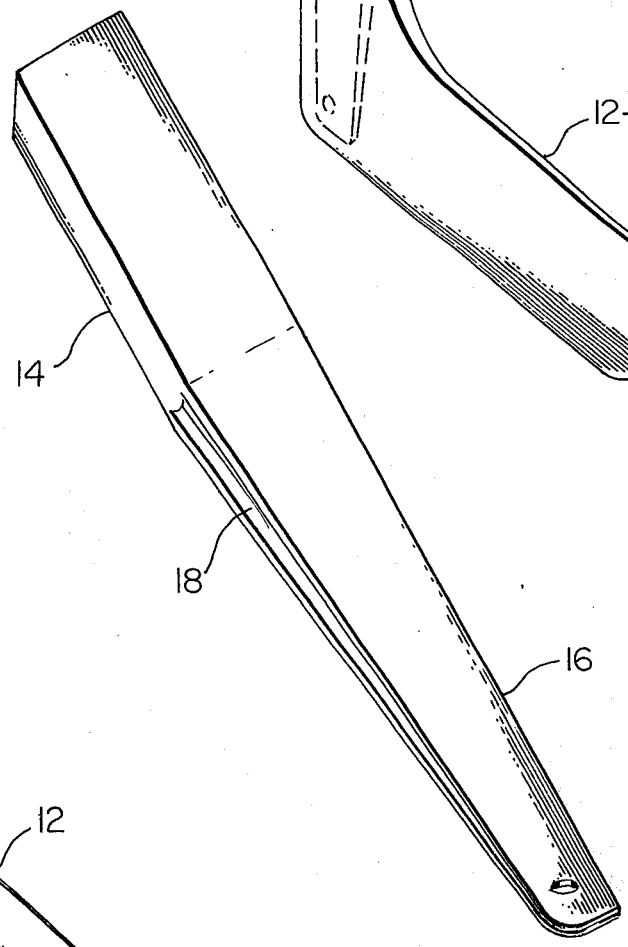
FIG. 3 is a perspective view of a hockey stick blade shank in accordance with the principles of the invention.
Figure 4:
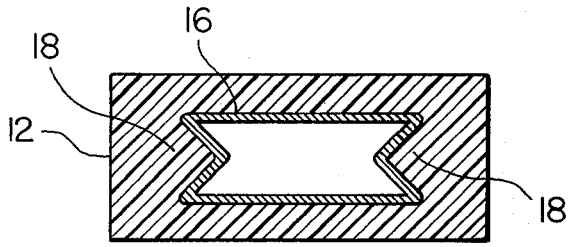
FIG. 4 is a cross-sectional view of a portion of the hockey stick blade depicted in FIG. 2, taken along the lines 4—4.

As shown in the drawing, a hockey stick embodying the invention comprises a shaft or handle 11, a blade 12 and a shank 13 interconnecting shaft 11 and blade 12. The shaft 11 is a hollow metal tube having a rectangular cross-section. Preferably, the tube 11 is of a light weight, high strength metal such as the aluminum alloy 2024-T6, although other materials having the desired characteristics may also be used.

Blade 12 is made of a material which is light weight and extremely resistant to breaking, cracking, splintering or chipping. The preferred material is a composite, fiber reinforced plastic, such as Nylon 6/6 filled with glass fiber. Graphite fibers may also be used, and other high strength, injection moldable plastics may be substituted for Nylon.

Shank 13 has an upper portion 14 with a rectangular cross-section adapted to mate with the lower end of shaft 11 in a four-plane lap joint. In the preferred illustrative embodiment, the outside of the upper portion 14 of shank 13 is sized to make a sliding, telescopic fit inside the hollow center of shaft 11, and to extend a substantial distance — for example, 2 inches or more — into shaft 11. The relatively large area and multi-planar configuration of the closely fitting lap joint results in a very strong junction when the parts are bonded in the preferred manner which is by a thermoplastic adhesive material such as that commonly used to cement the ferrules on fishing rods.

The lower portion 16 of shank 13 is tapered from the relatively large cross-section of upper portion 14 to a smaller cross-section inside the heel 17 of molded plastic blade 12. The tip of lower portion 16 extends substantially to the bottom of heel 17, and is permanently joined to blade 12, which is molded about it as disclosed herein. Tapered lower portion 16 of shank 13 also includes at least one blade-retaining recess 18 adapted to be filled with the plastic material of the blade during the molding process so that the bond between shank 13 and blade 12 is made more resistant to separation under the forces likely to be imposed on it during play. In the preferred embodiment, recess 18 is tapered from a relatively large width near its upper end to a relatively narrow width at its lower end. Thus, when shank 13 is joined to blade 12, recess 18 is filled by a wedge-like projection of molded material, which strongly resists any forces tending to pull blade 12 off shank 13. By making the depth of recess 18 a substantial fraction of the width of lower portion 16, the junction is also given great resistance to forces tending to twist blade 12 on shank 13. Since the preferred material for blade 12 shrinks somewhat upon curing after the molding process, it contracts tightly about lower portion 16 of shank 13, further adding to the strength of the bond.

In the illustrative embodiment of the invention, shank 13 is smaller in cross-section than shaft 11 and so is adapted to fit into the lower end of shaft 11. By making the thickness of the molded plastic material encasing shank 13 approximately equal to the thickness of the walls of shaft 11, a pleasingly smooth appearance is achieved at the joint.

Shank 13 may be made of the same or a similar material as shaft 11, and may also be made of hollow rectangular tubing. The taper and blade retaining recess 18 of lower portion 16 of shank 13 may be formed, for example, by creasing the sides of the tube with a knife-edge die, and then compressing the portion to be tapered with a flat, inclined die so that the creased side-walls fold inward along the creases. The resulting recess is in the form of a triangular slot with its base toward the upper end and its apex toward the lower end of shank 13. When formed in the manner described, the depth of the slot will increase from zero at the upper end of shank 13 to a maximum at the lower end where the compression-created taper results in the maximum flattening of the originally rectangular hollow metal tube, with consequent maximum inward folding of the tube side-walls. Also, when formed by the method described, it will be appreciated that there will be a pair of such slots or recesses, as one will be produced in each of the two side walls of the tapered portion of the shank. However, the slot or recess may be formed by a variety of other processes, in which case the depth of the slot may vary or be uniform along the length of the shank, and advantageously should be about one-fourth to one-third of the width of the shank.

A hockey stick embodying the invention may have a shaft or handle with weight and flexibility precisely tailored to a player's preferences. By eliminating the variations attendant upon the used of wood, the desired characteristics are made consistently reproducible, so that a player will no longer have to play with other than his optimally preferred stick or spend time trying out various wooden sticks to find one that suits him. The wall thickness and cross-section of the shaft may be increased or decreased to provide hockey sticks to satisfy most requirements. Further control over the playing characteristics may be achieved by tapering the lower end of the shaft to provide more flexibility, or even by tapering the thickness of the tube wall. Tapers may be made along one or more dimensions to provide differing flexibility in different directions.

For most players, a relatively light but rigid shaft will be preferred, and flexibility will be desired in the throat portion of the blade. Here, variations may be provided by controlling the taper of the lower portion 16 of shank 13. Should a player's blade become worn or damaged, the integral blade and shank may be removed from the shaft by heating the thermoplastic adhesive bonding of the lap joint, and a new assembly having precisely the same —or different preferred— characteristics may be mounted in its place. Thus, the need to replace the handle is substantially eliminated. Because of the consistency, great strength and long wearing properties of the invention, the recurrent breakage of hockey sticks in play is substantially reduced and with it, the need to maintain a large supply of replacements for selection by team members.

Many variations and modifications are possible and may be made without departing from the scope and spirit of the invention. For example, the hollow metal handle may be filled with a plastic foam to provide a different feel; the shaft may be enclosed by a rubber or plastic material to insulate the player's hands from the metal. Still other adaptations will be apparent to those skilled in this art.

What is claimed is:

1. A hockey stick comprising a shaft, a blade and a shank interconnecting the shaft and the blade;

the shaft being formed of a metal tube having a rectangular cross-section;

the shank being formed of a metal tube having a rectangular cross-section with an upper portion adapted to mate removeably with the lower end of the shaft and a lower portion adapted to be affixed permanently to a molded plastic blade, the lower portion being tapered in at least one dimension from the upper portion to a smaller section at its lower ends and having at least one blade retaining recess in its surface, said recess being tapered from a relatively wide cross-section toward the shaft end to a narrower cross-section toward the blade end of the shank;

the shaft and the shank being joined in a four-plane bonded lap joint with the lower end of the shaft receiving and lapping the exterior of the upper portion of the shank;

the blade being formed of fiber reinforced plastic and molded permanently to the lower portion of the metal shank and substantially filling the blade retaining recess, with the lower end of the shank extending substantially to the heel portion of the blade.

2. The hockey stick of claim 1 wherein the blade retaining recess comprises an elongated triangular notch extending along a side of the lower portion of the shank with its base toward the upper end and its apex toward the lower end of the shank.

3. The hockey stick of claim 2 wherein the blade retaining triangular notch has a substantially triangular transverse cross-section.

4. The hockey stick of claim 1 wherein the lap joint of the shank and the shaft is bonded with a thermoplastic adhesive material.

5. A hockey stick comprising a shaft, a blade and a shank interconnecting the shaft and the blade;

the shaft being formed of a hollow metal tube having a rectangular cross-section;

the shank being formed of a hollow metal tube with an upper portion having a rectangular cross-section adapted to fit into the lower end of the hollow shaft to form a four-plane lap joint, and a lower portion tapered from the relatively large cross-section of the upper portion to a relatively small cross-section at its lower end, the lower portion of the shank having at least one longitudinal blade-retaining recess on its external surface, the recess being tapered from a relatively large cross-section at its upper end to a smaller cross-section at its lower end;

the blade being formed of a fiber reinforced plastic molded about the lower portion of the shank and filling the recesses with the lower portion of the shank extending to the heel portion of the blade;

the upper portion of the shank being fitted into the lower end of the shaft and bonded with a thermoplastic adhesive.

* * * * *